US006062925A

United States Patent [19]

Salmi et al.

[11] Patent Number: 6,062,925

[45] Date of Patent: May 16, 2000

[54] SERVICE VESSEL OPERATING METHOD

[75] Inventors: Pekka Salmi, Vantaa; Risto Kurimo, Espoo, both of Finland

[73] Assignee: Kvaerner Masa-Yards Oy, Helsinki, Finland

[21] Appl. No.: 09/126,431

[22] Filed: Jul. 30, 1998

[30] Foreign Application Priority Data

Jul. 31, 1997 [FI] Finland ..... 973171

[51] Int. Cl.[7] ..... B63H 1/28; B63H 3/00; B63H 5/14

[52] U.S. Cl. ..... 440/67; 114/40; 440/50

[58] Field of Search ..... 440/66, 67, 50; 114/40

[56] References Cited

U.S. PATENT DOCUMENTS

| | | | |
|---|---|---|---|
| 4,427,393 | 1/1984 | May | 440/71 |
| 4,550,673 | 11/1985 | Ingvason | 440/67 |
| 5,101,128 | 3/1992 | Veronesi et al. | 310/54 |

FOREIGN PATENT DOCUMENTS

| | | | |
|---|---|---|---|
| 2 618 406 | 1/1989 | France | 440/67 |
| 2 627 742 | 9/1989 | France | 440/67 |
| 11-91687 | 4/1999 | Japan . | |
| 1027079 | 7/1983 | U.S.S.R. | 440/67 |

OTHER PUBLICATIONS

LARADI KESÄPÄIVÄT (document 1), R. Järvinen, Aug. 21, 1992, pp. 1–3 (translation enclosed).

LARADI KEÄPÄIVAT (document 2), P. Salmi, Aug. 14, 1992, pp. 1–3 (translation enclosed).

LARADI KESAÄPÄIVÄT (document 3), "Azimuthing Electric Propulsion Electric Propulsion Drive Azipod" published by Kvaerner Masa–Yards Oy and ABB Marine (ABB Strömberg Drives Oy).

*Primary Examiner*—Sherman Basinger

*Attorney, Agent, or Firm*—John Smith-Hill; Smith-Hill and Bedell

[57] ABSTRACT

A service vessel that is designed for navigating both in the open sea and in ice conditions is provided with a demountable propeller nozzle. For an ice-free navigation period the propeller nozzle is mounted around the propulsion propeller of the vessel, whereas for a navigation period in ice conditions the propeller nozzle is removed. The power absorption of the propulsion propeller is maintained constant during nozzle and nozzle-free operation.

20 Claims, 3 Drawing Sheets

(II - II)

(III - III)

(V - V)

(VI - VI)

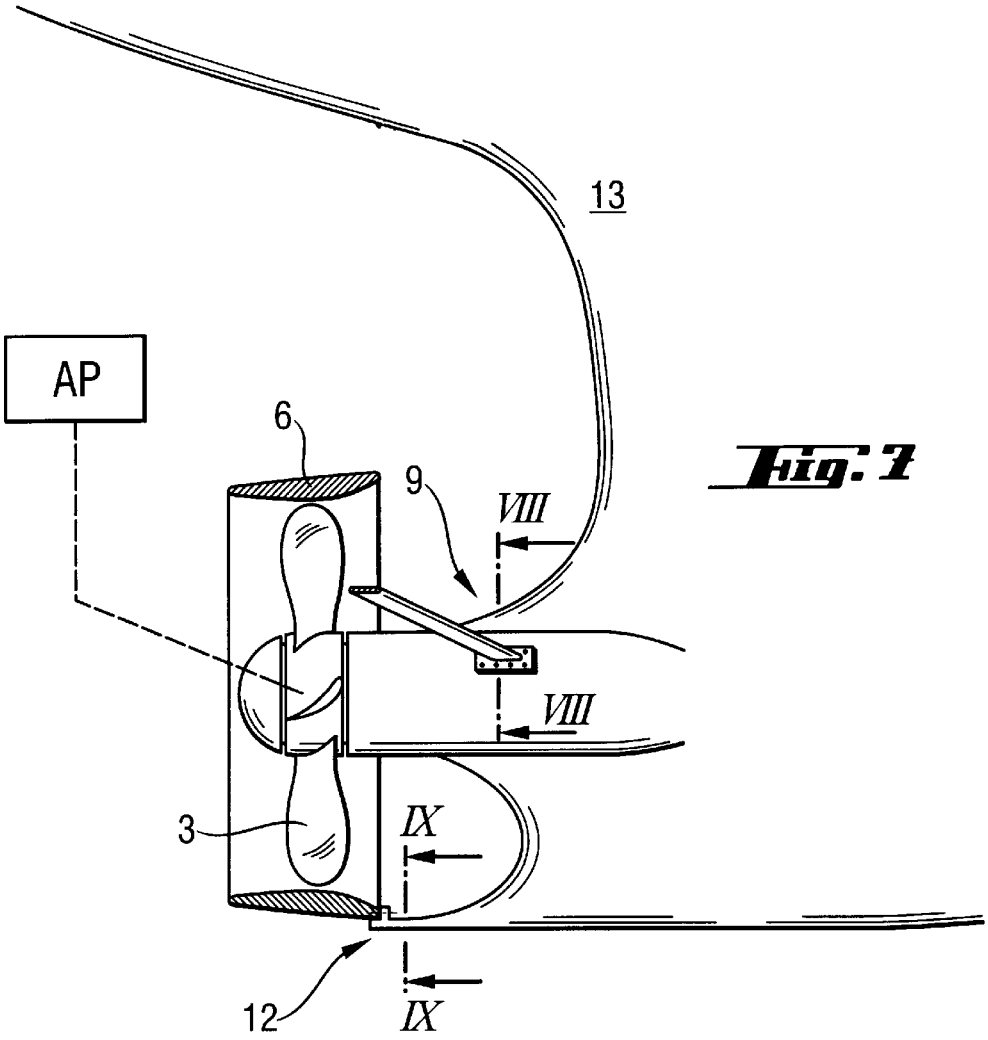
Fig. 7
Fig. 8
(VIII - VIII)
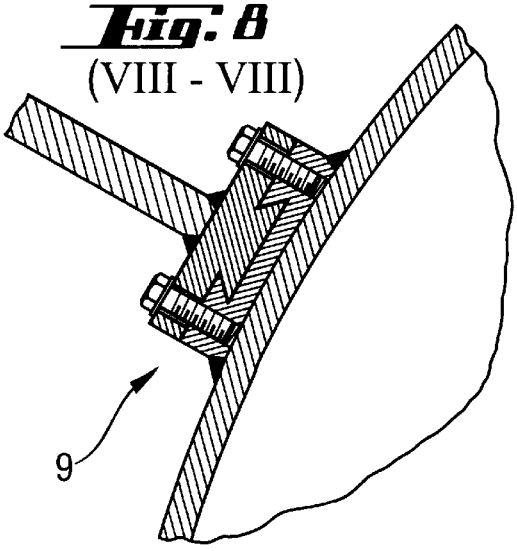
Fig. 9
(IX - IX)
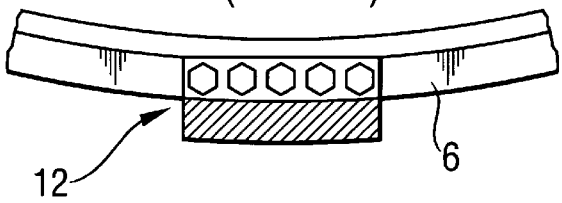

SERVICE VESSEL OPERATING METHOD

BACKGROUND OF THE INVENTION

This invention relates to a service vessel operating method and to a service vessel for applying the operating method.

The main propulsion engine of a ship is typically a diesel engine. Generally, the operating speed of the engine is constant and is the speed at which the power output is maximum. It is known that at low speeds the propulsion force of a ship or vessel can be increased by using nozzle propellers, wherefore nozzle propellers are generally used in so-called service vessels, especially tow-boats (tugs). Nozzle propellers have also been used in vessels designed for navigation in ice. However, ice tends to block or obstruct the nozzle, and this causes flow disturbances in the propeller leading to a weakening of the propulsion force and to severe vibrations. Attempts have been made to lessen these problems by specific designs of the bottom of the ship and by using additional devices, but these attempts have not generally produced noteworthy results.

The object of this invention is to provide an operating method by which the above mentioned disadvantages are avoided and which provides for an efficient use of a service vessel in a reliable manner and with simple means.

SUMMARY OF THE INVENTION

The basic idea of the invention is that the operating arrangement of the propulsion propeller means is changed according to prevailing circumstances.

Firstly, the change in the operating arrangement may be realized by providing a propeller nozzle that is easily mountable and demountable around the propulsion propeller means, and fastening means suitable for mounting and demounting the propeller nozzle.

For facilitating the change of the operation arrangement of the propulsion propeller means it is advantageous that the fastening means is such that mounting and demounting of the propeller nozzle can easily be carried out without docking of the vessel. For example, the propeller nozzle fastening means preferably comprises a simple mechanical connection such as a dovetail joint, a wedge joint, a flange joint or the like.

Secondly, the propulsion propeller means is operated so that the power absorption of the propeller is substantially the same for nozzle operation and nozzle-free operation. When a fixed-pitch propeller is rotated at a given speed, it encounters a lower resistance if it is operating in a nozzle than if it is nozzle-free. Accordingly, the power absorption of the nozzle propeller is lower than the power absorption of the nozzle-free propeller. If a nozzle propeller and a nozzle-free propeller are operated with equal power absorption, the speed of rotation of the nozzle propeller is higher than that of the nozzle-free propeller.

The invention is not restricted to a particular type of propeller and accordingly the propeller may be a fixed-pitch propeller or a propeller with an adjustable pitch. Consequently, when using a fixed-pitch propeller the propulsion machinery has to be chosen so that it is suitable for both nozzle operation and nozzle-free operation. With a fixed-pitch propulsion propeller means the power absorption of the propeller is kept constant by setting the normal operating speed of rotation of the propeller to a certain nominal value when using the propeller nozzle and by setting the normal operating speed of rotation of the propeller to a value at least 5 percent, preferably at least 10 percent, lower than said nominal value, when the propeller nozzle is removed.

If a propeller with an adjustable pitch is used, the pitch has to be adaptable to both nozzle operation and nozzle-free operation. With a propulsion propeller means with an adjustable pitch the power absorption of the propeller is kept constant by setting the pitch of the propeller to a certain nominal value when using the propeller nozzle and by adjusting the pitch of the propeller to a value at least 7 percent, preferably at least 10 percent, lower than the nominal value when the propeller nozzle is removed.

When using a fixed-pitch propulsion propeller means the service vessel is provided with means for maintaining the speed of rotation of the propeller in one of two clearly different ranges, for nozzle operation and nozzle-free operation respectively. In this case it is advantageous that the different ranges for the speed of rotation of the propeller differ from each other so that the lower range of the speed of rotation is 65 to 95 percent, preferably 75 to 90 percent, of the average speed of the higher range of the speed of rotation.

When using a propulsion propeller means with an adjustable pitch the service vessel is provided with means for setting the pitch of the propeller at one of two clearly different values, for nozzle operation and nozzle-free operation respectively. In this case it is advantageous that the lower value of the pitch of the propeller is 60 to 95 percent, preferably 70 to 90, percent of the higher value.

BRIEF DESCRIPTION OF THE DRAWINGS

The invention is described in more detail in the following by way of example and referring to the attached schematic drawings, in which:

FIG. 7 shows a conventional propeller device at the rear end of a ship provided with a propeller nozzle, FIG. 8 is an enlarged cross-sectional view along the line VIII—VIII of FIG. 7, and FIG. 9 is an enlarged cross-sectional view along the line IX—IX of FIG. 1.

DETAILED DESCRIPTION

The operating method according to the invention is intended to be applied to a service vessel which is operated both in the open sea and in ice conditions. For operation in the open sea a propeller nozzle is mounted around the propulsion propeller of the service vessel and the nozzle is removed when the service vessel is to be operated in ice conditions.

Figure 1:
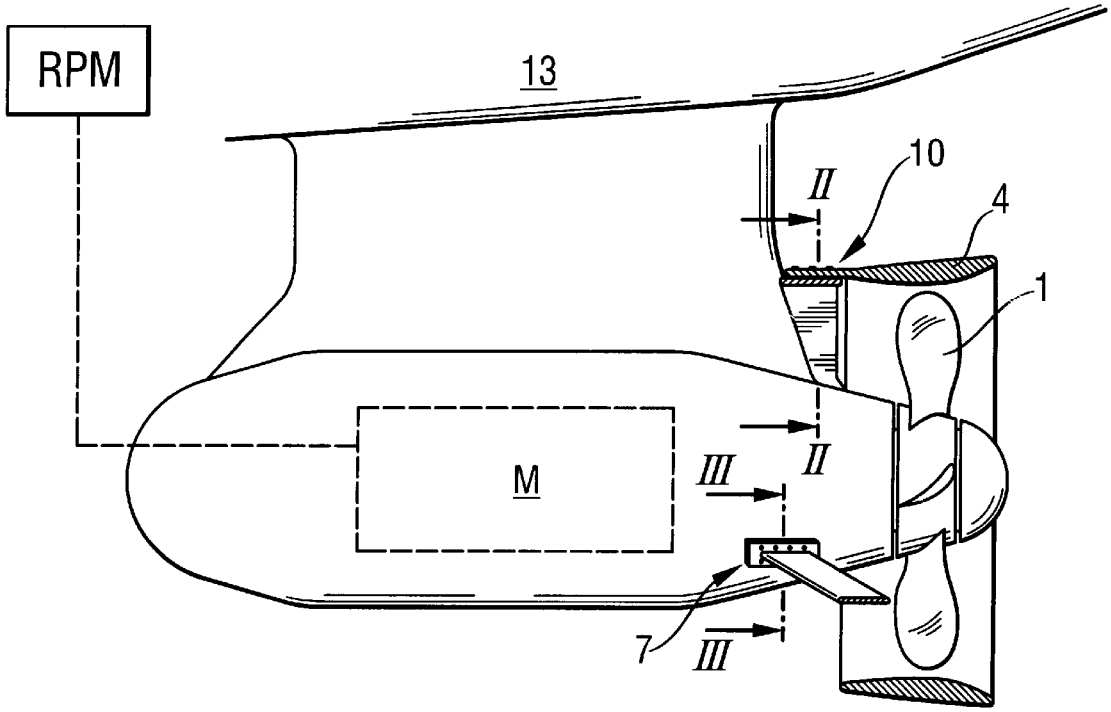
FIG. 1 shows an electrical rudder propeller device with a so-called pulling propeller nozzle.

The rudder propeller device shown in FIG. 1 of the drawings includes a propeller pod which is attached to the hull of a service vessel 13 by a turnable shaft. In FIG. 1, 1 designates a screw propeller and 4 a propeller nozzle.

Figure 2:
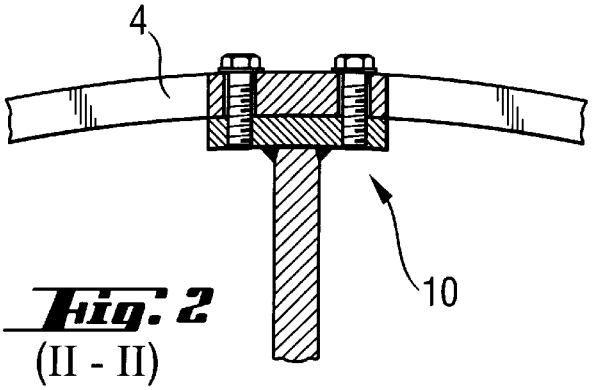
FIG. 2 is an enlarged cross-sectional view along the line II—II of FIG. 1.
Figure 3:
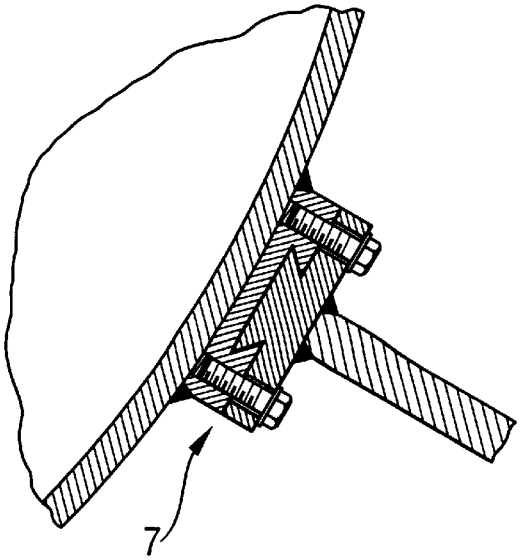
FIG. 3 is an enlarged cross-sectional view along the line III—III of FIG. 1.

For facilitating the mounting and demounting of the propeller nozzle 4, the propeller nozzle fastening means may comprise, for example, a dovetail joint, a wedge joint, a flange joint or the like. Examples of suitable joints are shown in FIGS. 2 and 3, in which the cross-sectional enlargements show fastening means 7 and 10 which are formed as a flange joint and a dovetail joint respectively. These fastening means are mechanically simple and easily mountable and demountable.

The propulsion propeller means and the propulsion machinery have also to be designed so that they are suitable for nozzle and nozzle-free use.

The propulsion propeller 1 shown in FIG. 1 is a fixed-pitch propeller, and the service vessel 13 comprises an electric drive motor M, which may be mounted in the propulsion pod, and a speed regulating mechanism RPM for controlling the operating speed of the electric motor M so as to maintain the speed of rotation of the propeller 1 in one of two clearly different ranges. The higher range of speed of rotation is intended for nozzle use in open sea and the lower range of speed of rotation for nozzle-free use in ice conditions.

Figure 4:
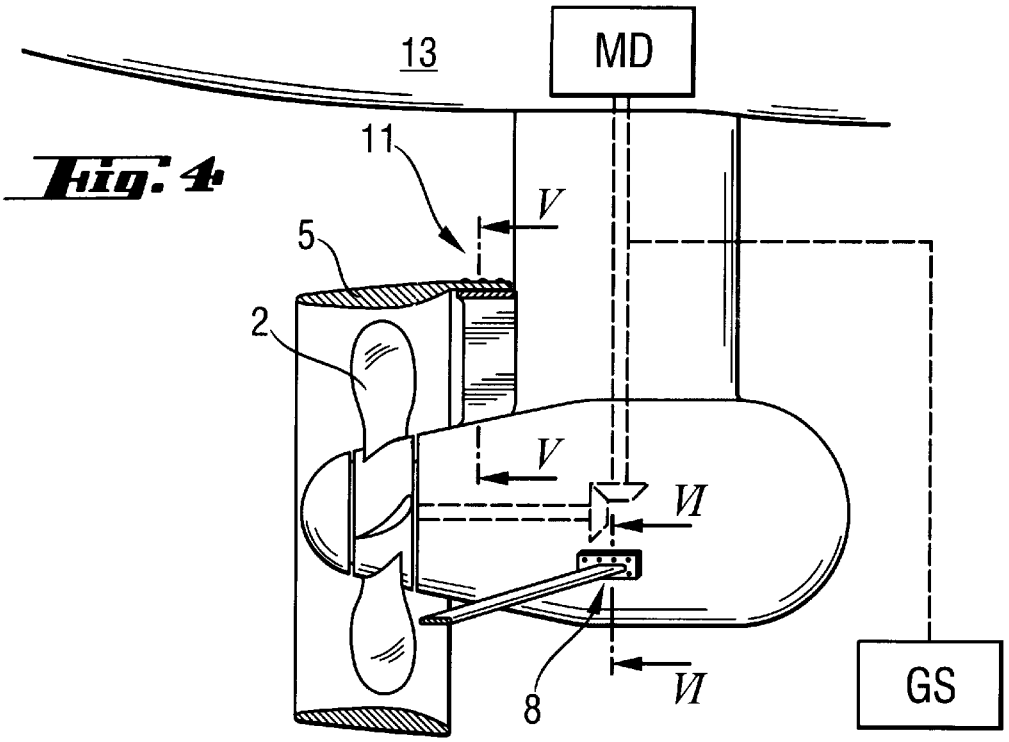
FIG. 4 shows a mechanical rudder propeller device with a so-callled thrusting propeller nozzle.
Figure 5:
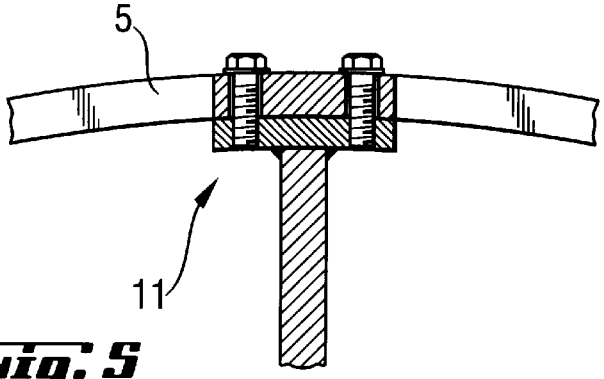
FIG. 5 is an enlarged cross-sectional view along the line V—V of FIG. 4.
Figure 6:
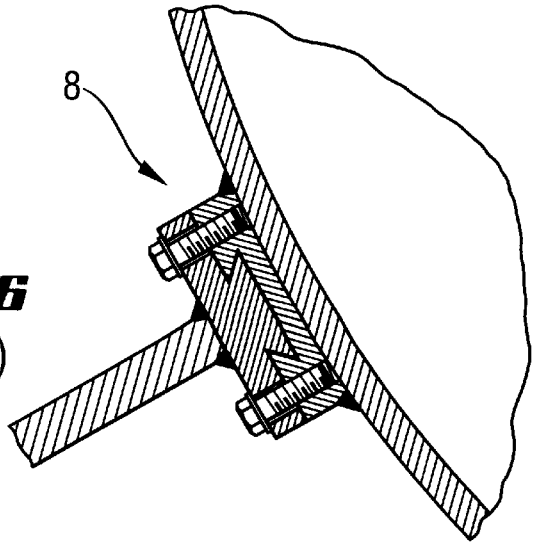
FIG. 6 is an enlarged cross-sectional view along the line VI—VI of FIG. 4.

FIG. 4 shows a fixed-pitch propulsion propeller 2 and a nozzle 5. In FIGS. 5 and 6, the cross-sectional enlargements show fastening means 8 and 11 which are formed as a flange joint and a dovetail joint respectively.

The service vessel 13 shown in FIG. 4 comprises a main drive engine (not shown) mounted in the hull and a mechanical drive MD connecting the drive engine to the propeller 2. The main drive engine operates at constant speed and power and may be, for example, a diesel engine. The mechanical drive MD includes a gear system GS which maintains the speed of rotation of the propeller 2 in one of two clearly different ranges of speed of rotation, depending on the gear ratio. The higher range of speed of rotation is intended for nozzle use in open sea and the lower range of speed of rotation for nozzle-free use in ice conditions.

The service vessel 13 shown in FIG. 7 comprises a drive motor (not shown) mounted in the hull and a propeller shaft connecting the drive motor to an adjustable-pitch propulsion propeller 3. The propeller 3 is provided with a nozzle 6. In FIGS. 8 and 9, the cross-sectional enlargements show fastening means 9 and 12 which are formed as a dovetail joint and a flange joint respectively.

When using a propulsion propeller with an adjustable pitch, the pitch of the propeller is adjusted to a greater value for nozzle use and to a smaller value for nozzle-free use. Accordingly the propeller 3 is provided with means AP for adjusting the pitch.

In the above different operation arrangements have been discussed in combination with specific propeller devices. However, it is clear that compatible arrangements can be interchanged, e.g. an electric motor may be used to drive a propeller with an adjustable pitch instead of driving a fixed-pitch propeller at an adjustable speed.

Since the fastening means are mechanically simple, the propeller nozzle is easily mountable and demountable, without it being necessary to dock the vessel. The nozzle can therefore be mounted and demounted as needed, depending on the current operating conditions. It will, however, be appreciated that the nozzle might instead be mounted or demounted based on expected operating conditions over an extended period.

The drawings and thereto related description are only intended for clarifying the basic idea of the invention. The operating method and the service vessel according to the invention may vary in detail according to the ensuing claims. For example, although the invention has been described above in connection with a service vessel having a single propulsion propeller, the invention is applicable also to a service vessel having multiple propulsion propellers. The propellers may be coaxially arranged, e.g. two propellers fore and aft respectively of the pod shown in FIG. 1, or they may be non-coaxially arranged, typically dual propellers symmetrically disposed relative to the vessel's center line.

What is claimed is:

1. A method of operating a service vessel having a propulsion propeller, comprising mounting a propeller nozzle around the propulsion propeller for navigation in open water and removing the propeller nozzle for navigation in ice conditions, and maintaining power absorption of the propulsion propeller at substantially the same level both when the propeller nozzle is mounted around the propulsion propeller and when the propeller nozzle is not mounted around the propulsion propeller.

2. A method according to claim 1, wherein the propulsion propeller is a fixed-pitch propeller and the method comprises rotating the propeller at a substantially constant first speed of rotation when the nozzle is mounted around the propeller and at a substantially constant second speed of rotation, at least 5 percent lower than the first speed, when the nozzle is not mounted around the propeller.

3. A method according to claim 2, wherein the second speed is at least 10 percent lower than the first speed.

4. A method according to claim 1, wherein the propulsion propeller is an adjustable-pitch propeller and the method comprises maintaining the pitch of the propeller at a substantially constant first value when the nozzle is mounted around the propeller and at a substantially constant second value, at least 7 percent lower than the first value, when the nozzle is not mounted around the propeller.

5. A method according to claim 4, wherein the second value is at least 10 percent lower than the first value.

6. A service vessel designed for operation both in open water and in ice conditions and including a propulsion propeller, a propeller nozzle, fastening means for mounting the propeller nozzle around the propulsion propeller, the fastening means allowing easy demounting of the propeller nozzle from around the propulsion propeller, and power regulating means for maintaining power absorption of the propulsion propeller at substantially the same level both when the propeller nozzle is mounted around the propulsion propeller and when the propeller nozzle is not mounted around the propulsion propeller, whereby the propeller can be operated as a nozzle propeller in open water and can be operated nozzle-free in ice conditions.

7. A service vessel according to claim 6, wherein the propeller is a fixed-pitch propeller and the power regulating means comprises means for maintaining the speed of rotation of the propeller substantially constant, either in a first range or in a second range, the second range being lower than the first range and the first and second ranges being mutually exclusive.

8. A service vessel according to claim 7, wherein the second range is 65–95 percent of the average speed of the first range.

9. A service vessel according to claim 8, wherein the second range is 75–90 percent of the average speed of the first range.

10. A service vessel according to claim 6, wherein the propeller is a fixed-pitch propeller and the power regulating means comprises means for maintaining the speed of rotation of the propeller substantially constant in a first range when the propeller nozzle is mounted around the propulsion propeller and for maintaining the speed of rotation of the propeller substantially constant in a second range when the propeller nozzle is not mounted around the propulsion propeller, the second range being lower than the first range and the first and second ranges being mutually exclusive.

11. A service vessel according to claim 10, wherein the second range is 65–95 percent of the average speed of the first range.

12. A service vessel according to claim 11, wherein the second range is 75–90 percent of the average speed of the first range.

13. A service vessel according to claim 6, wherein the propeller is an adjustable-pitch propeller and the power regulating means comprises means for maintaining the pitch of the propeller substantially constant, either at a first value or at a second value, the second value being lower than the first value.

14. A service vessel according to claim 13, wherein the second value is about 60–95 percent of the first value.

15. A service vessel according to claim 14, wherein the second value is 70–90 percent of the first value.

16. A service vessel according to claim 6, wherein the propeller is an adjustable-pitch propeller and the power regulating means comprises means for maintaining the pitch of the propeller substantially constant at a first value when the propeller nozzle is mounted around the propulsion propeller and for maintaining the pitch of the propeller substantially constant at a second value when the propeller nozzle is not mounted around the propulsion propeller, the second value being lower than the first value.

17. A service vessel according to claim 16, wherein the second value is about 60–95 percent of the first value.

18. A service vessel according to claim 17, wherein the second value is 70–90 percent of the first value.

19. A service vessel according to claim 6, wherein the fastening means comprises a simple mechanical connection.

20. A service vessel according to claim 19, wherein the fastening means is a dovetail joint or a flange joint.

* * * * *